United States Patent [19]

Braziel

[11] Patent Number: 4,667,884

[45] Date of Patent: May 26, 1987

[54] PAINT GUN TIP FILTER, ATOMIZER AND GASKET COMBINATION

[76] Inventor: Bobby G. Braziel, 320 S. Avery, Moore, Okla. 73160

[21] Appl. No.: 839,910

[22] Filed: Mar. 13, 1986

Related U.S. Application Data

[63] Continuation-in-part of Ser. No. 718,535, Apr. 1, 1985, abandoned, which is a continuation-in-part of Ser. No. 516,545, Jul. 22, 1983, abandoned.

[51] Int. Cl.[4] ..... B05B 1/14

[52] U.S. Cl. ..... 239/590; 239/575

[58] Field of Search ..... 239/590, 290.3, 575, 239/86, 553.3, DIG. 23, DIG. 14, 515; 277/165; 210/337-339, 445, 456, 499

[56] References Cited

U.S. PATENT DOCUMENTS 2,607,954 8/1952 Schneider et al. ..... 210/445
2,739,711 5/1956 Holden ..... 239/553.3
3,065,918 11/1962 Hostetter ..... 239/575
3,138,332 6/1964 Hinderer ..... 239/590.3

FOREIGN PATENT DOCUMENTS 1927695 7/1978 Fed. Rep. of Germany ... 239/553.3

*Primary Examiner*—Andres Kashnikow
*Assistant Examiner*—Kevin Patrick Weldon
*Attorney, Agent, or Firm*—Glen M. Burdick

[57] ABSTRACT

In an improved paint spray gun combination having a spray discharge portion with a discharge orifice for pressurized spray discharge of liquid paint, a paint gun tip filter, atomizer and gasket combination comprising a resilient gasket ring having an axial bore and a plurality of filter screens disposed within the gasket ring in filtering relationship to the liquid paint discharging through the discharge orifice. The bore is characterized as having a substantially frustro-conical shaped inlet portion and a substantially cylindrical-shaped outlet portion.

9 Claims, 6 Drawing Figures

PAINT GUN TIP FILTER, ATOMIZER AND GASKET COMBINATION

CROSS REFERENCE TO RELATED APPLICATION

This is a continuation-in-part application of my copending patent application entitled "IMPROVED PAINT GUN TIP FILTER AND GASKET COMBINATION", U.S. Ser. No. 718,535, filed Apr. 1, 1985, now abandoned which is a continuation-in-part application of U.S. patent application entitled, "PAINT GUN TIP FILTER AND GASKET COMBINATION," U.S. Ser. No. 516,545, filed July 22, 1983, now abandoned.

1. FIELD OF THE INVENTION

The present invention relates to the field of paint application, and more particularly but not by way of limitation, to an improved paint spray gun tip filter, atomizer and gasket combination for use in a paint spray gun wherein the paint is filtered and atomized immediately prior to release.

2. DISCUSSION

Since the initial invention of pressurized paint spray guns, there has been a need to filter the paint that flows to the spraying device. There are means for filtering the paint as it is put into a pressurized system and as it leaves the pressurized vessel. In the past, there has been a need to prevent clogging of the paint gun tip from materials that are not filtered out of the system at the time of paint input into the pressurized vessel or as the paint is disbursed from the spray tank. In addition, there are materials that are in the hose and spray gun apparatus that are not filtered and frequently cause clogging of the spray gun tip; this results in down time in the use of the spraying system as the system is broken down and cleaned. Furthermore, there is a need to repair the surface area being sprayed if foreign material is sprayed onto it, causing a paint defect.

Another source of difficulty is the coagulation of paint droplets prior to discharge from the spray device. Such coagulation can be caused by many factors, many of which are beyond the control of the ordinary operator. Regardless of the reason for such coagulation, the result is that such coagulation often leads to droplet spattering on an otherwise uniformly sprayed surface. When this happens, the operator must break down the spray device, clean it and readjust the spray system with the hope of quickly resolving the problem so as to minimize the effect on the surface being sprayed. Also, the operator must skillfully remove the spattered droplets from the sprayed surface and return the surface to as good condition as possible before commencing the spraying process.

The present invention seeks to provide a solution to the long existing problem by a combination of filtering and atomizing the paint emitted from the tip of the paint spray gun which, while appearing quite simple, has alluded prior art attempts to achieve near perfect spraying conditions.

SUMMARY OF THE INVENTION

It is an object of the present invention to provide an improved system for the filtration of paint sprayed by means of a tip filter/gasket combination used in pressurized spraying systems of the type found in commercially available gun units.

Other objects, advantages and features of the present invention will become apparent to those of ordinary skill in the art upon reading the following description in conjunction with the accompanying drawings and the appended claims.

DESCRIPTION

The term "atomizer" as used herein is to be understood to mean a mechanism or device for breaking a liquid, such as paint, into very small particles as same is sprayed from the tip of the spray gun. Thus, reference to the term "atomized" as used herein is to be understood to mean small, discrete particles of paint.

Figure 1:
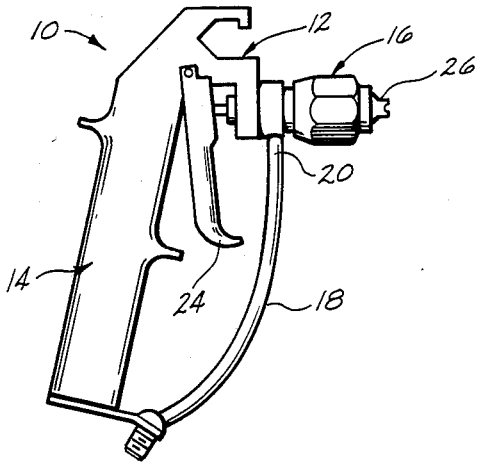
FIG. 1 is an elevational view of a pressurized airless spray gun of conventional construction equipped with the filter, atomizer and gasket combination of the present invention.

Referring to the drawings in general, and more particularly to FIG. 1, shown therein is a conventional airless paint spray gun 10 of the type which utilizes the combined filter, atomizer and gasket of the present invention. The paint spray gun 10 comprises a hand held spray unit 12 having a handle portion 14 and a spray discharge portion 16. A paint conduit 18 attaches at one end 20 thereof to the hand unit 12, and the other end 22 is externally threaded for hose attachment (not shown) to a conventional pressurized paint container (also not shown).

A trigger mechanism 24 is provided and connects via internal mechanisms to the spray discharge portion 16 to actuate the spray discharge portion 16 and permit paint spray discharge from the paint conduit 18 through a nozzle tip 26 of the spray discharge portion 16. Further description of the paint spray gun 10 is not necessary for the purpose of the present description because the structure of the paint spray gun 10 is conventional except as further described hereinbelow with regard to the improved paint gun tip filter, atomizer and gasket combination of this invention.

Figure 2:
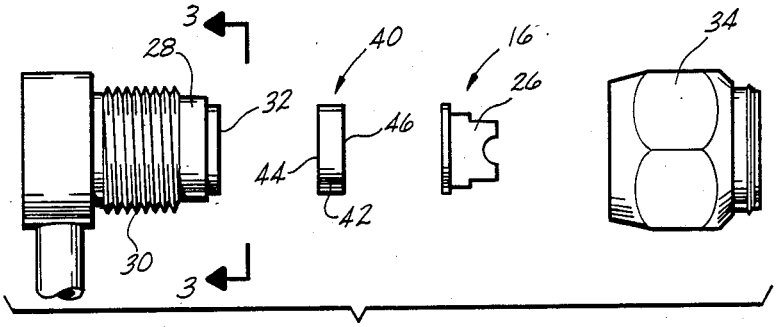
FIG. 2 is an exploded view of the spray nozzle assembly of FIG. 1 as equipped with the present invention.
Figure 3:
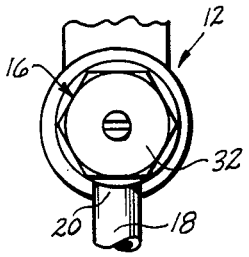
FIG. 3 is a view taken at 3—3 in FIG. 2.

FIG. 2 shows an exploded view of the spray discharge portion 16 which attaches to a male portion 28 of the hand held spray unit 12. The male portion 28 is threaded at portion 30 and has a planar seating surface 32 at the end thereof, as shown in FIG. 3. The spray discharge portion 16 comprises a hollow tubular member 34 having internal threads (not shown) which mate with the threaded portion 30 for attachment thereto; the external shape of the spray discharge portion 16 is conveniently shaped to accept the application of a conventional wrench for attachment and detachment to and from the male portion 28.

Disposed within the tubular member 34 is the nozzle tip 26 which has a discharge orifice therethrough which serves to finally discharge the paint spray. The nozzle tip 26 is dimensioned to be retained within the bore of the tubular member 34, protruding from the bore as shown in FIG. 1.

Normally, in the set up of the conventional paint spray gun, a gasket is disposed between the nozzle tip 26 and the planar seating surface 32 when the spray discharge portion 16 is attached to the male portion 28 of the hand unit 12. In the present invention, a combination filter, atomizer and gasket member 40 is provided.

Figure 4A:
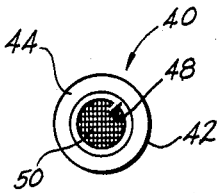
FIG. 4A is a view of one end of the filter, atomizer and gasket combination of the present invention.
Figure 4B:
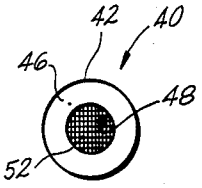
FIG. 4B is a view of an opposed end of the filter, atomizer and gasket combination of the present invention.

Referring now to FIGS. 2, 4A and 4B, the filter, atomizer and gasket member 40 comprises a gasket ring 42 having a first side or end portion 44, an opposed second side or end portion 46 and a bore 48 extending therethrough. Disposed across the bore 48 is a first filter screen 50 and a substantially parallel, spatially disposed second filter screen 52. The first and second filter screens 50 and 52 are fabricated of a mesh material having appropriately spaced openings to filter particulate and coagulated matter in the paint passing therethrough. The first and second filter screens 50, 52 can be constructed of any suitable mesh material such as wire or plastic screening, and when the gasket ring 42 is fabricated from a resilient elastomeric material, the first and second filter screens 50, 52, are preferably molded integrally into the gasket ring 42 and disposed in the matter depicted by the cross sectional view of FIG. 5.

Figure 5:
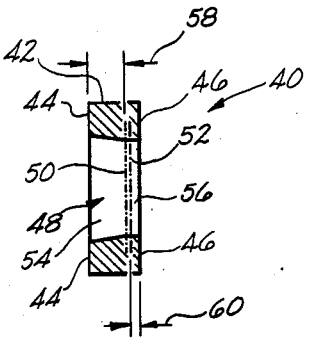
FIG. 5 is an enlarged cross sectional view of the filter, atomizer and gasket combination of the present invention.

As more clearly shown in FIG. 5, the bore 48 of the gasket ring 42 is characterized as having a first or inlet portion 54 and a second or outlet portion 56. The inlet portion 54 of the bore 48 is provided with a generally frustro-conical configuration; and the outlet portion 56 of the bore 48 is provided with a generally cylindrical configuration. Thus, the inlet portion 54 and the outlet portion 56 of the bore 48 provide the bore 48 with a substantially funnel-shaped configuration as shown. The funnel-shaped configuration of the bore 48, in combination with the first and second filter screens 50, 52 (as well as the location of the filter screens 50, 52 within the bore 48) are believed to provide the atomizer effect on the paint stream flowing therethrough which results in a more uniform flow of small, discrete particles of paint than has heretofore been achievable. This atomizing and filtering of the paint provides a more uniform and even coat of paint on the surface being painted, as well as unexpectedly extending the useful life of the filter, atomizer and gasket member 40.

The first filter 50 of the filter, atomizer and gasket member 40, which is substantially normally disposed to the central axis of the bore 48, is positioned at the junction of the inlet portion 54 and the outlet portion 56 of the bore 48 such that the first filter is disposed a distance 58 from the first side 44 of the gasket ring 42. As illustrated in the drawing, the distance 58 is approximately equal to about two-thirds of the overall length of the bore 48. The second filter 52 of the filter, atomizer and gasket member 40, which is also substantially normally disposed to the central axis of the bore 48 and in a substantially parallel, spatial relation with the first filter 50, is positioned a distance 60 from the second side 46 of the gasket ring 42 so as to be in a substantially recessed position with respect to the second side portion 46 of the gasket ring 42. Thus, the first filter 50 functions not only to trap debris, but also as a shock absorber. This feature, in combination with the additional filtering function of the second filter 52, and the configuration of the bore 48, produces a more controlled and uniform dispersment of paint from the nozzle tip 26 than has heretofore been achieved.

The filter, atomizer and gasket member 40 of the present invention also serves as a spacer member between the nozzle tip 26 and the male portion 28 as the spray discharge portion 16 is screwed onto the hand unit 12 of the paint spray gun 10 in order to eliminate metal being tightened against metal, and further, the filter, atomizer and gasket member 40 allows for a tightening tolerance for adjusting the positioning of the nozzle tip 26 appropriately within protruding disposition in the tubular member 34. As previously stated, the first and second filters 50, 52 of the filter, atomizer and gasket member 40 cooperate to trap any debris which might otherwise pass through the paint conduit 18 and out through the orifice of the nozzle tip 26 and the filters 50 and 52 and the filters 50 and 52, in combination with the configuration of the bore 48 and the positioning of the filters 50, 52 therein, provide a uniform flow of small, discrete particles of paint exiting the orifice of the nozzle tip 26 of the paint spray gun 10. In practice, it has been determined that one of the nylon materials is quite suitable for use in making the gasket ring 42, and that nylon mesh of 200 microns works well as the first and second filters 50, 52 of the filter and gasket member 40 with a large range of liquid paints that are commerically used in this country.

It is clear that the present invention is well adapted to carry out the objects and to attain the ends and advantages mentioned hereinabove, as well as those inherent within the present invention. While a preferred embodiment of the invention has been described for the purpose of this disclosure, numerous changes can be made which will readily suggest themselves to those skilled in the art and which are encompassed within the spirit and scope of the invention disclosed herein and as defined in the appended claims.

What is claimed is:

1. A paint gun tip filter, atomizer and gasket combination comprising:

a resilient gasket ring having a first side, an opposed second side and a bore extending therethrough, said bore characterized as having a substantially frusto-conical shaped inlet portion and a cylindrical-shaped outlet portion;

a first filter supported by the gasket ring so as to be substantially normally disposed to the central axis of the bore, said first filter being positioned at the junction of the frustro-conical shaped inlet portion and the cylindrical-shaped outlet portion of the bore a selected distance from the first side of the resilient gasket ring; and, a second filter supported by the gasket ring so as to be disposed within the cylindrical-shaped outlet portion of the bore, said second filter being positioned substantially normal to the central axis of the cylindrical-shaped outlet portion of the bore and in a substantially parallel, spatial relationship with the first filter, the second filter being positioned a distance from the second side of the resilient gasket ring so as to be in a recessed postion, the first filter functioning as a shock absorber for paint directed therethrough, the first and second filters cooperating to remove debris from paint passing therethrough, and the first and second filters, in combination with the shape of the bore substantially atomizing paint passing therethrough such that substantially small, discrete particles of paint exit therefrom.

2. The paint gun tip filter and gasket combination of claim 1 wherein the gasket ring is constructed of an elastomeric material.

3. The paint gun tip filter and gasket combination of claim 2 wherein the first and second filters comprise a screen material, and the distance between the first filter and the first side of the gasket ring is greater than the distance between the second filter and the second side of the gasket ring.

4. The paint gun tip filter and gasket combination of claim 3 wherein the screen material is nylon mesh of about 200 micron openings.

5. The paint gun tip filter and gasket combination of claim 3 wherein the screen material forming the first and second filters is molded onto the gasket ring.

6. In combination with an airless, pressureized paint spray gun having a spray discharge portion for pressurizing spray discharge of liquid paint, the improvement comprising filter means disposed within the spray discharge portion for absorbing the shock force of pressurized liquid paint passing therethrough and for filtering and atomizing the liquid paint prior to its discharge from the paint spray gun, said filter means comprising;

a resilient gasket ring having a first side, an opposed second side and a bore extending therethrough, said bore having a substantially frusto-conical shaped inlet portion and a substantially cylindrical-shaped outlet portion;

a first filter supported by the gasket ring at the junction of the frustro-conical shaped inlet portion and the cylindrical-shaped outlet portion of the bore so as to be substantially normally disposed to the central axis of the bore a first distance from the first side of the resilient gasket ring, said first filter fabricated of a screen material of about 200 mesh openings; and, a second filter supported by the gasket ring so as to be substantially normally disposed to the central axis of the bore and in a substnatially parallel, spatial relationship with the first filter, the second filter fabricated of a screen material of about 200 mesh openings and positioned a second distance from the second side of the resilient gasket ring so as to be recessed relative to the second side, the first filter acting as a shock absorber for paint directed therethrough, the first and second filters cooperating to remove debris from paint passing therethrough, and the first and second filter, in combination with the configuration of the bore, cooperating to substantially atomize paint passing therethrough such that substantially small, discrete particles of paint are discharged from the spray discharge portion of the paint spray gun.

7. The improvement of claim 6 wherein the gasket ring is constructed of an elastomeric material, and the first distance between the first filter and the first side of the gasket ring is greater than the second distance between the second filter and the second side of the gasket ring.

8. The improvement of claim 7 wherein the screen material is fabricated of nylon mesh.

9. The improvement of claim 8 wherein the nylon mesh forming the first and second filters is molded into the gasket ring.

* * * * *